United States Patent [19]

Ushikoshi

[11] 4,421,420

[45] Dec. 20, 1983

[54] ELECTRONIC TIMEPIECE WITH ANIMATION

[75] Inventor: Kenichi Ushikoshi, Suwa, Japan

[73] Assignee: Kabushiki Kaisha Suwa Seikosha, Tokyo, Japan

[21] Appl. No.: 281,156

[22] Filed: Jul. 7, 1981

[30] Foreign Application Priority Data

Jul. 9, 1980 [JP] Japan ..... 55-96362[U]

[51] Int. Cl.[3] ..... G04B 19/06; G04B 25/06

[52] U.S. Cl. ..... 368/229; 368/80

[58] Field of Search ..... 368/80, 45, 203, 204, 368/229

[56] References Cited

U.S. PATENT DOCUMENTS 2,667,738 2/1954 Eichholz ..... 58/106

*Primary Examiner*—Bernard Roskoski

*Attorney, Agent, or Firm*—Blum, Kaplan, Friedman, Silberman & Beran

[57] ABSTRACT

An electronic analog timepiece having an illustration on the dial provides animation by including a portion of the illustration on the second hand and by giving the second hand an erratic motion. Logic circuitry combines a plurality of frequency signals from the divider circuits such that periodic but erratic second hand motion is achieved between moments when the second hand is accurate. Normal second hand motion is also selectively provided.

15 Claims, 9 Drawing Figures

ELECTRONIC TIMEPIECE WITH ANIMATION

BACKGROUND OF THE INVENTION

This invention relates generally to an electronic analog timepiece having hands and an illustration on the dial and more particularly, to an electronic analog timepiece where the illustration includes animation. In the prior art, in a digital timepiece having a liquid crystal display, an interesting animation including an animal is presented by a combination of a portion of the liquid crystal display and an illustration on the partition or parting plate of the liquid crystal display. For example, a character winks its eye, the winking eye is part of the liquid crystal display. In other animations, a ball moves, etc. In an analog timepiece which displays the time using hands, and in a mechanical timepiece having a main spring, an indicator is mounted on the shaft of a pallet, so that reciprocation of the pallet is propagated to that of the indicator to provide animation. But such a display is of little interest as a dynamic animation. In particular, it generally only uses hands on which a picture is set.

What is needed is an electronic analog timepiece which has animation exceeding a conventional hand motion.

SUMMARY OF THE INVENTION

Generally speaking, in accordance with the invention, an electronic analog timepiece having an especially interesting animated display is provided. The timepiece has an illustration on the dial and provides animation by including a portion of the illustration on the second hand and by giving the second hand an erratic motion. Logic circuitry combines a plurality of frequency signals derived from the divider circuits used for timekeeping such that erratic but periodic second hand motion is achieved between moments when the second hand is accurately representing time. Normal second hand motions, that is, one motion per second, is also selectively provided by means of an externally actuated member.

Accordingly, it is an object of this invention to provide an improved electronic analog timepiece having an animated face.

Another object of this invention is to provide an improved electronic analog timepiece having animation through erratic motion of the second hand while the hour and minute hands keep accurate time.

A further object of this invention is to provide an improved electronic analog timepiece having animation through erratic second hand motion as well as normal second hand motion capability.

Still another object of this invention is to provide an improved electronic analog timepiece having animation which includes accelerated forward and reverse motion of the second hand.

Yet another object of this invention is to provide an improved electronic analog timepiece having animation through erratic motion of the second hand, yet having a periodically accurate second hand motion.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
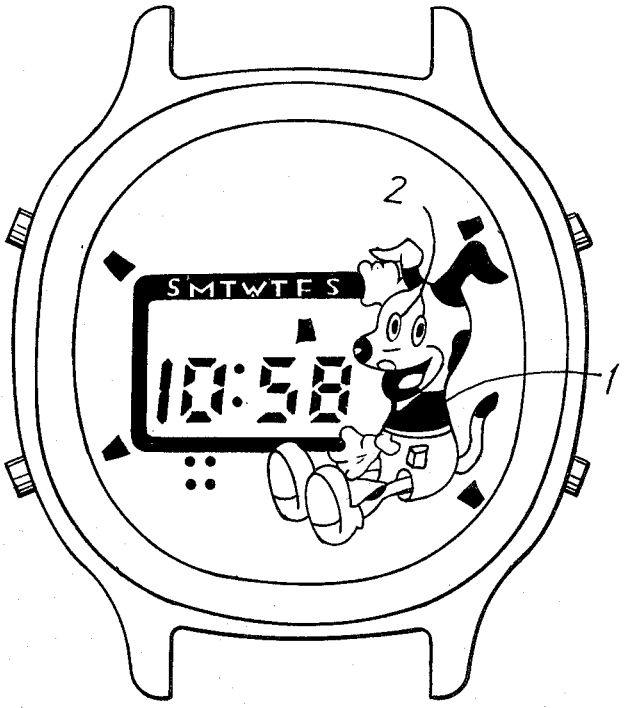
FIG. 1 shows the face, to an enlarged scale, of a digital timepiece having animation.

With reference to FIG. 1, a timepiece using a liquid crystal display, that is, a digital timepiece, animation is provided by a combination of a portion of the liquid crystal display and a parting plate including an animal animation. A static picture 1 on the parting plate is combined with a pair of eyes 2 which are formed on an electrode of the liquid crystal display panel. The eyes 2 are made to flash every second. In an electronic digital timepiece using a liquid crystal display, it is simple to cause the eyes 2 to flash without introducing any error in the hour and minute display. This is done by providing the conventional electrodes for the hour and minute display and using signals derived from a divider circuit receiving inputs from a standard signal vibrator for driving the eyes.

Figure 2:
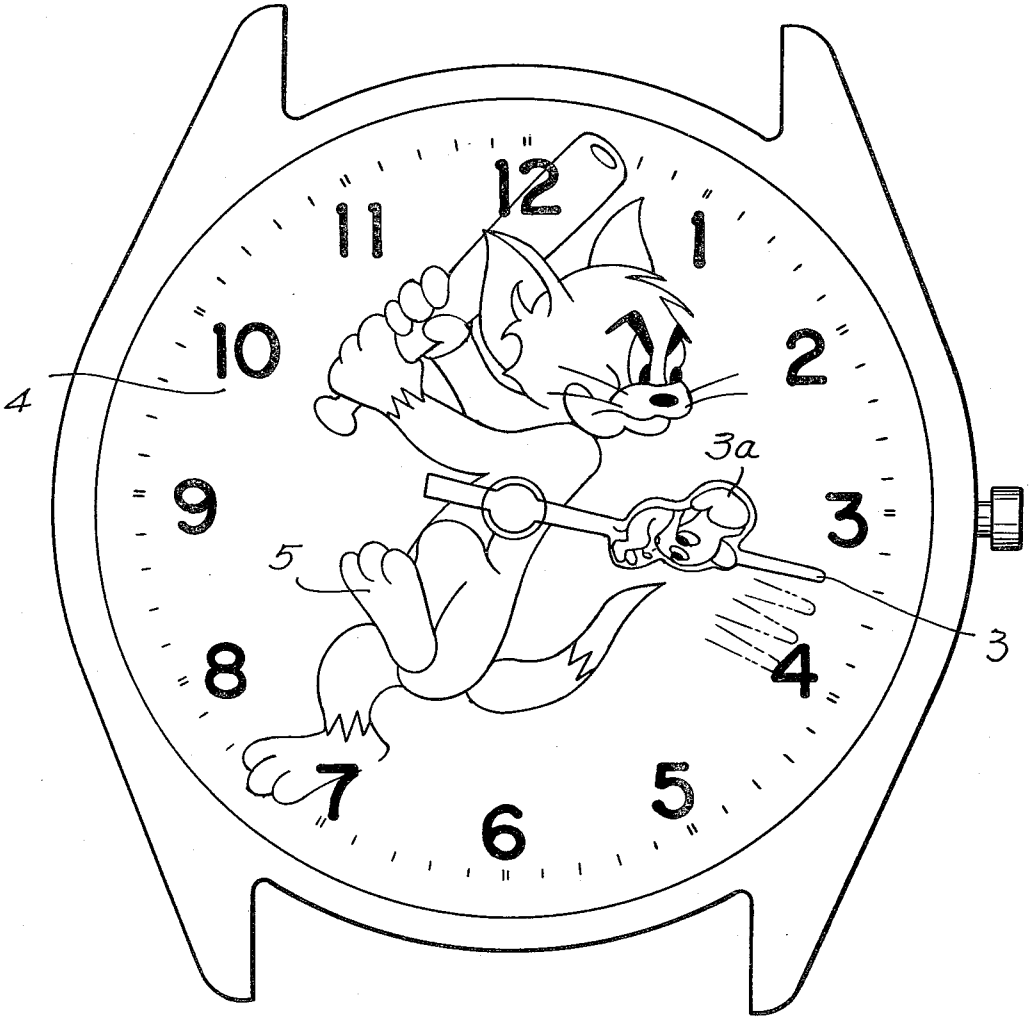
FIG. 2 is the face to an enlarged scale of a prior art analog timepiece including animation.

In a mechanical timepiece providing an analog display using hands driven by a mechanical mechanism using a main spring, an indicator is mounted on the shaft of a pallet, so that reciprocation of the pallet is propagated to that of the indicator, thus giving motion to the indicator. FIG. 2 shows an analog timepiece having a second hand 3 on which the figure of a mouse 3*a* is placed, a dial 4 and the illustration of a cat 5 on the dial 4. The mouse 3*a* rotates at a constant speed as indicated by the broken lines and this provides animation relative to the static figure of the cat 5. However, such a display provides little interest as a dynamic animation. That is because the animation is only a display using conventional hands on which a picture is positioned. An object of the electronic timepiece in accordance with this invention is to provide an electronic analog timepiece providing an interestingly animated display. An embodiment of an electronic analog timepiece in accordance with this invention having an animated display is described with reference to FIGS. 3 through 7.

Figure 3:
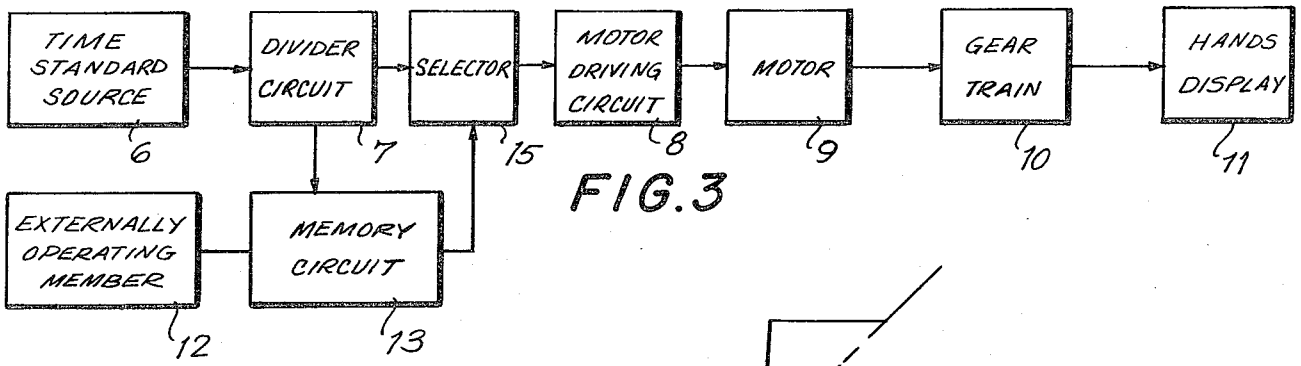
FIG. 3 is a functional block diagram of an electronic analog timepiece in accordance with this invention.

FIG. 3 is a functional block diagram of an electronic analog timepiece in accordance with this invention having a time standard source 6 which outputs a high frequency signal using an oscillator circuit including, for example, a quartz crystal resonator. The high frequency output signal is divided down in a divider circuit 7 which outputs a 1 Hz signal. These signals pass through a selector 15, have the waveform shaped by a motor driving circuit 8, and then are applied to a pulse motor 9. The oscillator, divider and wave shaping and driving circuits can include MOS integrated circuits, and the like. When driven, the motor 9 rotates its rotor in the usual manner, and the rotation is transmitted to a gear train 10 so that time is displayed by the hands of an analog display 11 comprising an hour, minute and second hands.

A memory circuit 13 counts a portion of the signals from the divider circuit 7 using either further divider circuit stages or a counter. An erratic signal from the memory circuit 13 is selectively applied to the motor driving circuit 8 by way of the selector 15. As explained more fully hereinafter, the selector function determines whether the timekeeping signal from the divider circuit 7 or the erratic signal from the memory circuit 13 drives the motor. Further, it is possible to control the memory circuit 13 by the manual setting of an externally operated member 12, but this is not a necessary requirement.

Figure 4:
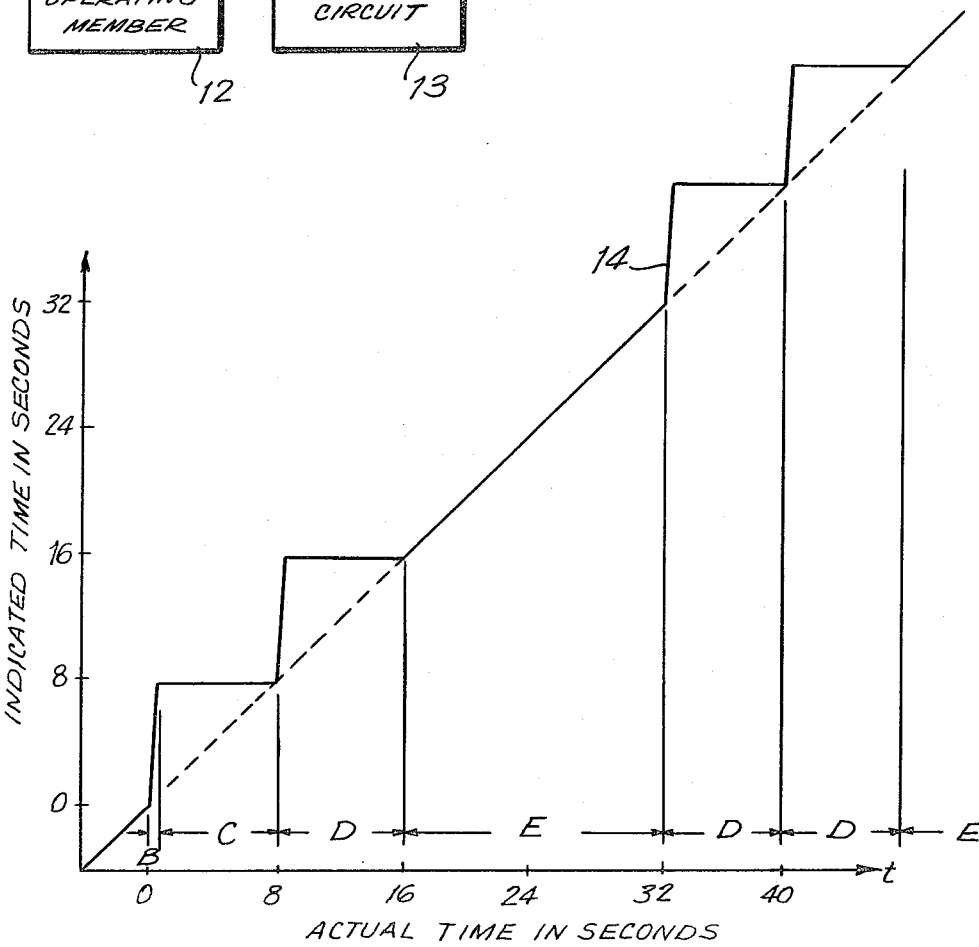
FIG. 4 is a diagram showing motion of the second hand of the timepiece of FIG. 3.

Before describing the electronic circuitry, FIG. 4 is described showing graphically the movements of the second hand which are achieved in the electronic analog timepiece in accordance with this invention. In FIG. 4, the abscissa shows real time and the ordinate shows the instaneous time that the second hand indicates on the watch dial. Where the scale of the ordinate and the abscissa are the same, as in FIG. 4, a line at 45 degrees to both axes would indicate a continuously accurate second hand which always indicates the true time. In FIG. 4, the solid line 14 shows the actual movement of the second hand in the timepiece in accordance with this invention of FIG. 3. In FIG. 4, period B is one of quick feeding or driving of the second hand where the indicated time is in advance of the actual time. The period C is one where motion of the second hand is stopped after the period B of accelerated motion. Thus, after eight seconds, the indicated time is again accurate with respect to the actual time. This illustrates a timepiece in which the second hand moves in one second increments. Depending upon circumstances, it is possible to change the period of second hand movement to provide shorter increments. In the period D, the hand movement repeats the actions of periods B and C. The period E provides for ordinary hand movement where indicated time corresponds to actual time and the second hand is accurate. In accordance with this embodiment, the second hand moves once a second during the period E. Then, an erratic or unusual second hand motion, that is, the period D, occurs again. In particular, it is seen that the second hand moves in an unusual manner as compared to its conventional movements.

Figure 5:
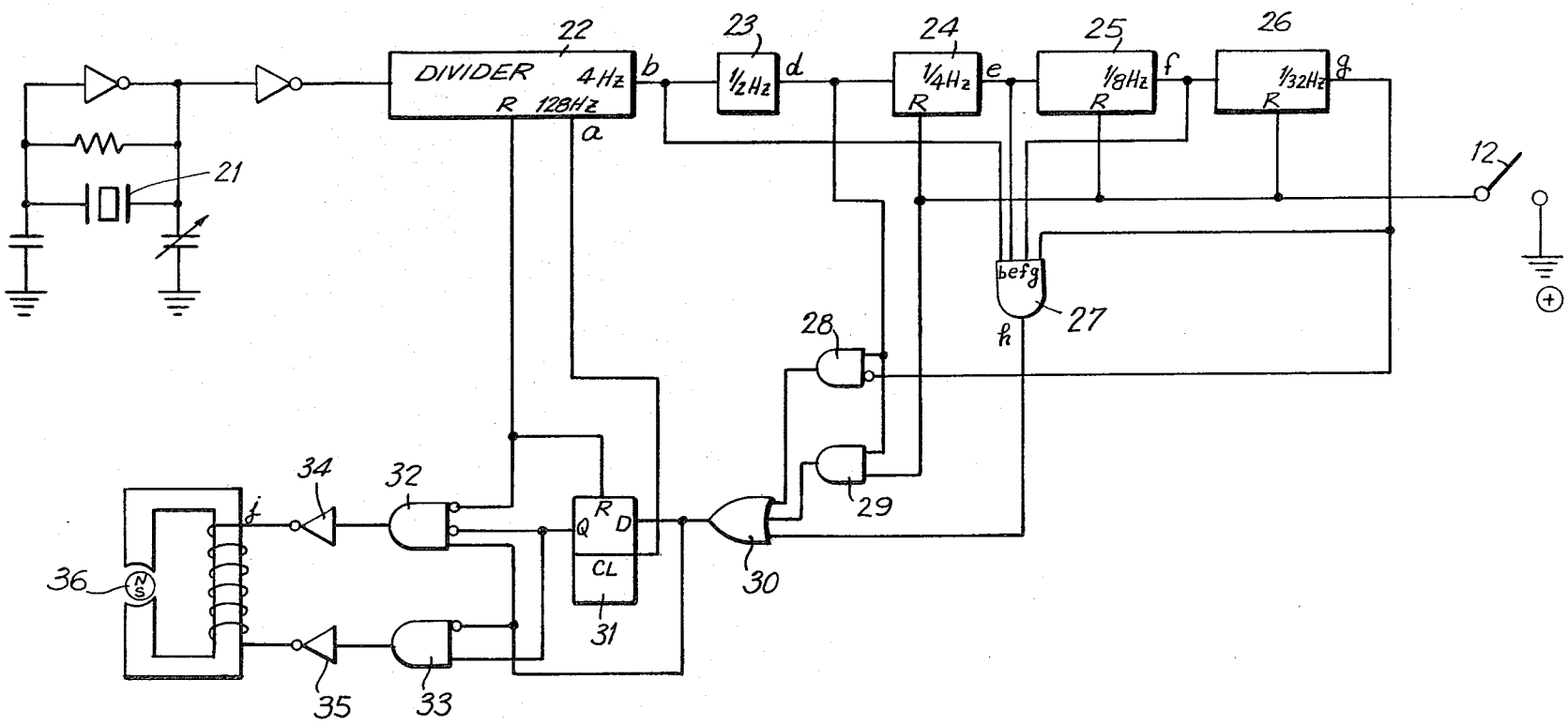
FIG. 5 is a circuit diagram of the timepiece of FIG. 3.
Figure 6:
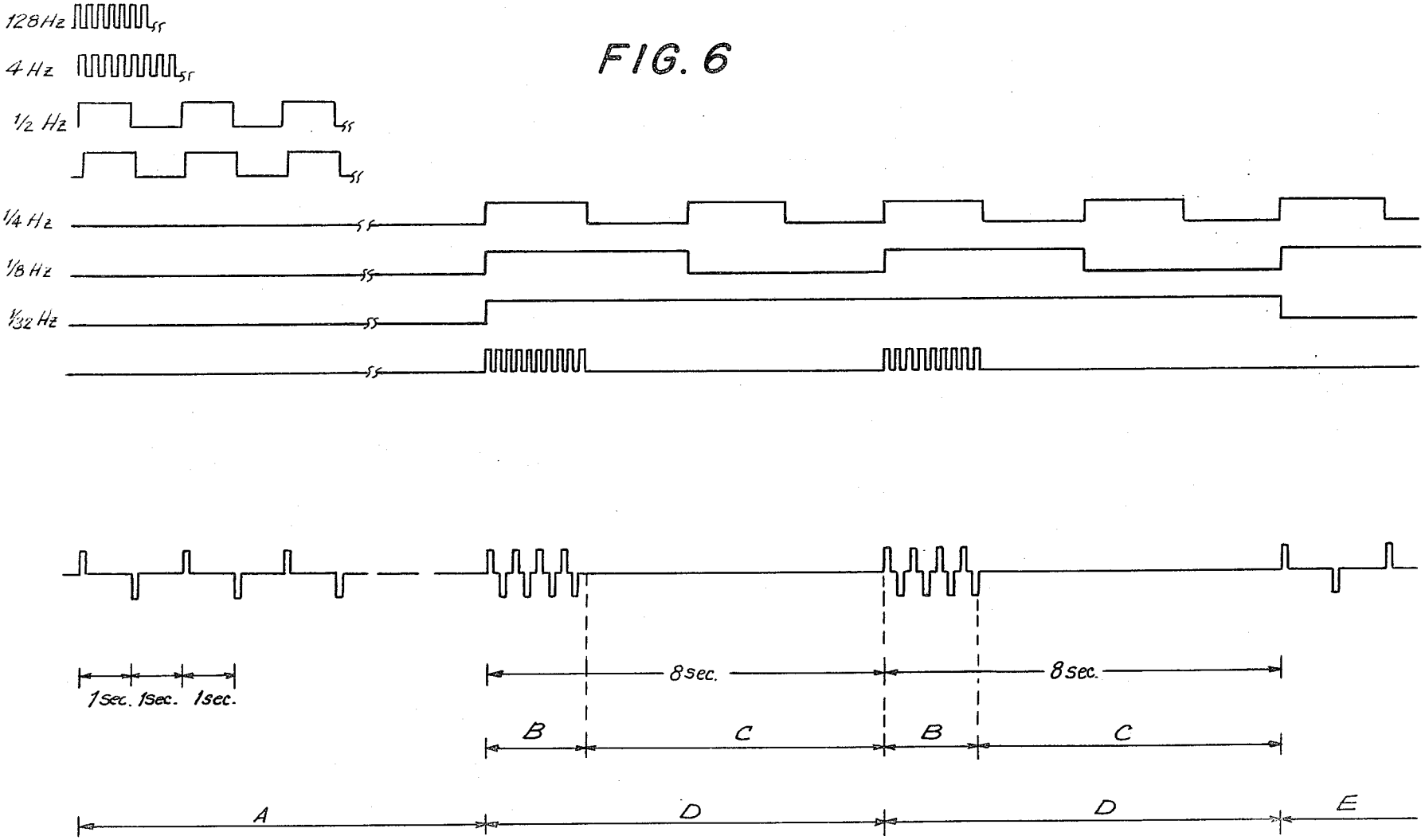
FIG. 6 is a timing chart associated with the circuit diagram of FIG. 5.

The circuit for producing such a motion is shown in FIG. 5 and has timing waveforms as indicated in FIG. 6. An oscillator circuit having a quartz crystal resonator 21 oscillates at a frequency in the order of 32,000 Hz and the output from the oscillator is divided down in a divider circuit 22 into a plurality of signals a,b having frequencies of 128 and 4 Hz respectively which are outputted. In a memory circuit in accordance with this invention, the output signals from the divider circuit 22 are readily stored using divider circuits 23–26 having signal outputs d–g respectively.

The signals b,e,f,g are inputted to an AND gate 27 which outputs a signal h, that is, the output signal h from the AND gate 27 is comprised of a combination of a $\frac{1}{4}$ Hz signal e, a $\frac{1}{8}$ Hz signal f and a 1/32 Hz signal g and with the 4 Hz signal b. These signals a,b,d-h are shown in their timed relationships in FIG. 6.

During the period A or E, when the 1/32 Hz signal g is low, no output signals h are supplied from the gate 27. However, the $\frac{1}{2}$ Hz signal d is inputted to one terminal of an AND gate 28 which also has the low 1/32 Hz signal g inputted to an inverted input. Therefore, the gate 28 passes the $\frac{1}{2}$ Hz signal to an OR gate 30, and the output of the OR gate 30 is inputted to the D terminal of a D-type delay flip-flop circuit 31. The delayed output of the flip-flop 31 is inputted to the gates 32,33 along with the output of the OR gate 30. The flip-flop 31 is clocked by the 128 Hz signal a. The delay through the flip-flop 31 is 1/128 seconds. The gates 32,33 comprise a well known waveform shaping circuit for providing signals j for driving the rotor 36 of a pulse motor. The outputs of the flip-flop 31 and OR gate 30, having the same frequency, pass alternately through the gates 32,33 and inverters 34,35 respectively to provide the signal j to the coil of the motor having the rotor 36 which is formed of a permanent magnet. The motor rotates in pulses in response to the signal j and drives the second hand with one pulse every second. During the period D, the 1/32 Hz signal g is high as are the signals e of $\frac{1}{4}$ Hz and f of $\frac{1}{8}$ Hz. Thus, the 4 Hz signal b passes through the gate 27 for one-half of the period of the $\frac{1}{4}$ Hz signal. In that time, that is, two seconds, eight cycles of the 4 Hz signal pass through the gate 27. During the period D when the signal g of 1/32 Hz is high, the gate 28 is blocked by the high signal g and does not pass the $\frac{1}{2}$ Hz signal d. However, the signal h, as stated above, does pass through the gate 27 to the OR gate 30, and operation of the remainder of the circuit driving the rotor 36 is as described above. However, it should be noted that the rotor receives eight pulses, not in eight seconds, but rather the eight pulses are received in a period of two seconds. The following six seconds are a period wherein the rotor 36 is not driven as indicated by the region C of FIGS. 4 and 6.

At the end of period C, while the 1/32 Hz signal g continues high, another burst of eight pulses occur in the signal j in a period B of two seconds. The second occurrence of the period B is followed by another period C wherein the second hand is again quiescent for six seconds.

Then, the signal g and 1/32 Hz goes low again and the normal once per second motion of the second hand resumes for 16 seconds.

In summary, the 1/32 Hz signal g to the gates 27,28 is controlling. When the 1/32 Hz signal g is low for sixteen seconds, there is normal operation of the second hand. When the 1/32 Hz signal g is high for sixteen seconds, there is the erratic motion comprised of two periods B of rapid motion, with each period B followed by a quiescent period C. It should be apparent that the periods B,C,D of FIG. 6 correspond to the similarly identified periods of FIG. 4.

A switch 12 cooperates with a winding stem (not shown). When the switch 12 is closed, a positive, that is, high potential is applied to the reset terminals of the dividers 24,25,26 which are reset. In this condition of the switch 12, the output signals e,f,g from the dividers 24,25,26 respectively are not outputted to the AND gate 27, that is, they are low. Accordingly, the gate 27 obstructs passage of the 4 Hz signal b. However, the ½ Hz signal d passes through an AND gate 29 and then through the OR gate 30 to the flip-flop 31 and subsequent gates and inverters 32–35. Accordingly, the rotor 36 is rotated in the conventional manner driving the second hand once per second over the angular distance representing one second.

In summarizing, the actions of the second hand are as follows:

| PERIOD | MOTION OF SECOND HAND | PERIOD DURATION | NUMBER OF MOTIONS OF SECOND HAND |
|---|---|---|---|
| B | quick feed at 4 Hz | 2 sec. | 8 |
| C | at rest | 6 sec. | 0 |
| B | quick feed at 4 Hz | 2 sec. | 8 |
| C | at rest | 6 sec. | 0 |
| E | normal feed at 1 Hz | 16 sec. | 16 |

Figure 7:
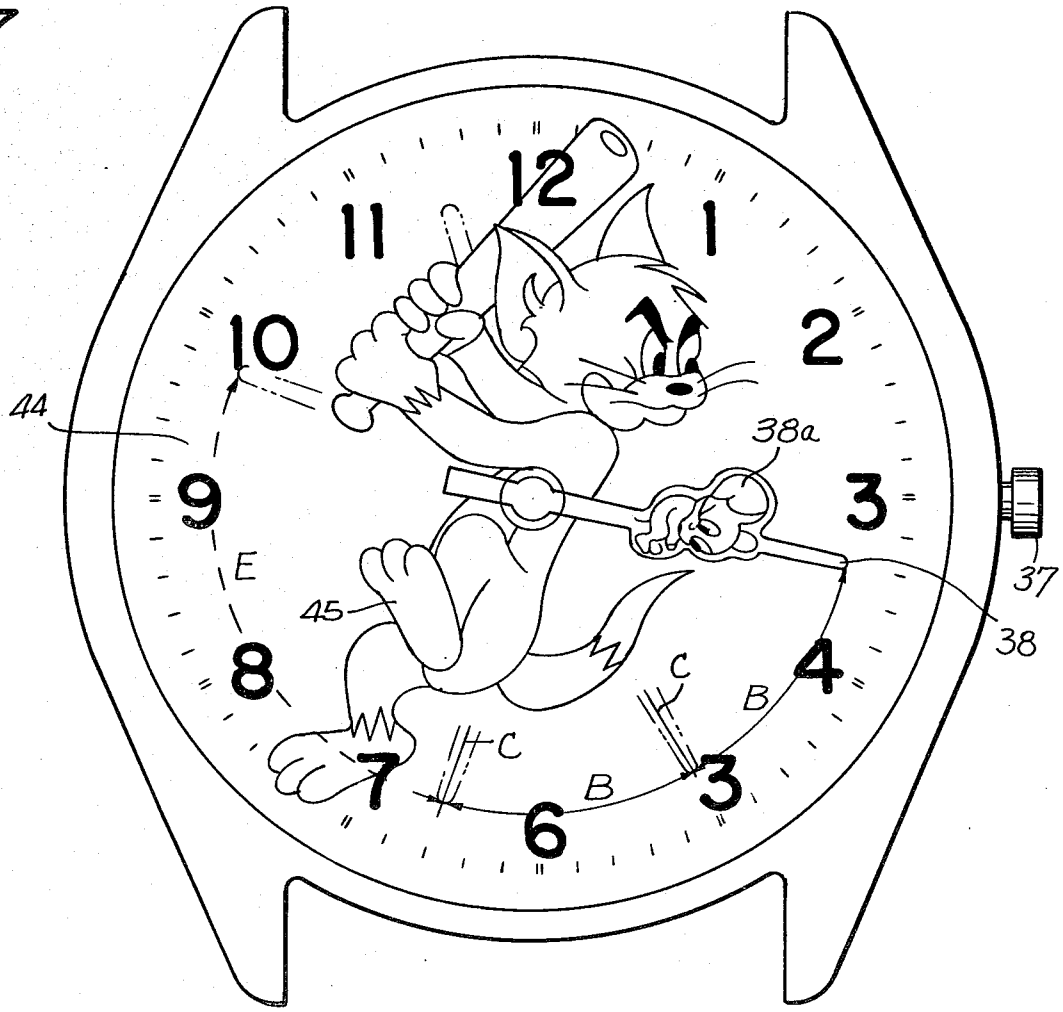
FIG. 7 is the face to an enlarged scale of an electronic analog timepiece in accordance with this invention using the hand movements of the second hand as produced by the circuit and timing of FIGS. 4,5 and 6, minute and hour hands are omitted.

In FIG. 7, the face or dial 44 of the watch includes the illustration of a cat 45. The second hand 38 includes the illustration of a mouse 38*a*. Rotational motion of the second hand 38 is indicated with broken lines and periods B,C and E are identified. In the example of FIG. 7, the second hand 38 rests (is static) at the dial numeral 5 and at the 33rd indication of the second. The animation can be viewed as if the cat 45 on the dial 44 runs after the mouse 38*a* and the mouse 38*a* escapes quickly. Then, the mouse 38*a* stops to see what its position and condition are, and then escapes and stops again, and then proceeds at the normal rate of one motion per second. It should be noted that because the cycle repeats in thirty-two seconds, as compared to thirty seconds, the location of the rest periods C is different for each consecutive rotation of the second hand 38. Also, it should be noted that every period of eight seconds has eight motions of the second hand such that during the period E and at the beginning of each period D the second hand is accurate, that is, the actual time and indicated time are identical. Where the minute and hour hands are in geared relationship with the second hand, the erratic second hand motion produces an imperceptible visual effect and the minute and hour hands provide continuously accurate time indicators.

In the embodiment described above in accordance with this invention, a second hand movement which repeats periods of rapid feeding followed by a rest period is described. But, depending upon the animations displayed on the dial, the divider ratios or counting coefficients can be modified at will using well known electronic circuits. Then, the speed of motion of the second hand can be selected at will. Further, such watches can have different features as follows: A conventional second hand, without the figure of a mouse, combined with a variety of second hand movements. Also, the combination of a baseball and a bat represented by a second hand and a picture on the dial can be considered. It should be recognized that with only a minor modification to the integrated circuits, the animated result of second hand with a picture included thereon and a fixed picture on the dial can be combined. It is not necessary to change any of the mechanical parts such as the gear train to get an animated interrelationship between the fixed illustration and the moving second hand illustration. Therefore, such a watch can still serve, with a modification of specification, as a satisfactory timekeeping watch.

Figure 8:
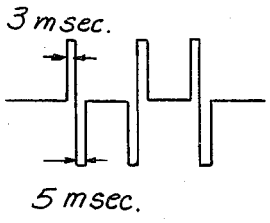
FIG. 8 is a waveform for a driving signal which causes the pulse motor of FIG. 5 to drive in reverse.
Figure 9:
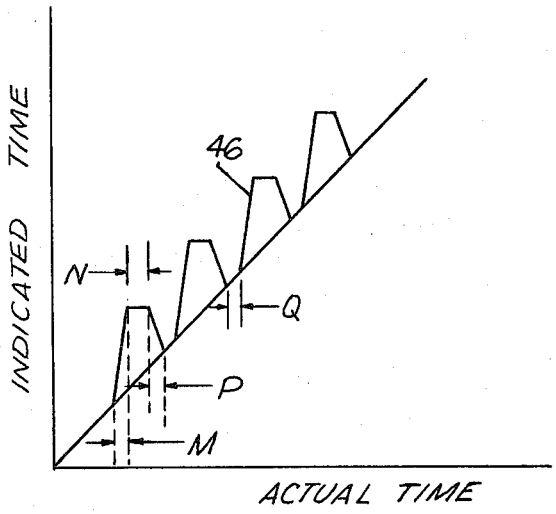
FIG. 9 is a diagram of motion for the second hand in an alternative embodiment of an electronic analog timepiece in accordance with this invention, and using both a forward and reverse driving signal for the motor.

FIG. 8 shows a waveform which when used to drive the rotor of a motor, operates the motor in reverse. FIG. 9 shows an example of the type of hand motion which is achieved by using a motor capable of being driven by the associated circuitry in both the forward and reverse directions. As illustrated in FIG. 9, there is a period M of accelerated second hand motion such that the indicated time is in advance of the actual time. Then follows a short rest period N wherein the second hand does not move. The rest period N is followed by a period P of accelerated and reverse motion which brings the indicated time into correspondence with the actual time. Then follows a short period Q of normal second hand operation after which another three periods as just described occurs, followed by a normal operating period Q. If these signals are applied to a dial as in FIG. 7, it can be considered that the mouse 38*a* on the second hand 38 escapes or returns or stops and so forth. This provides an interesting dynamic display for a wristwatch and is especially suitable for children.

It will thus be seen that the objects set forth above, among those made apparent from the preceding descriptions, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. In an electronic timepiece having a source of high frequency standard signals, a timekeeping divider circuit dividing down said high frequency standard signals to a timekeeping signal of a lower frequency, a motor, means for driving said motor in response to said timekeeping signals, a display including hands driven by said motor, the improvements therein comprising:

a dial and a second hand having illustrations thereon;

means for obstructing passage of said timekeeping signals to said motor driving means;

means for generating and inputting a secondary signal to said motor driving means, said timekeeping signals being obstructed, said secondary signals causing said motor to drive at an erratic rate, at least said secondary signals outputting a stop signal with a period lonqer than that of said timekeeping signal, said hands being stationary during said stop period, and a quick feed signal with a constant period shorter than that of said timekeeping signal;

total motion of said second hand produced by said stop signal and said quick feed siqnal causing said second hand to indicate the same accurate second display position as if driven over the same elapsed time by said timekeeping siqnal, switch means for selecting one of said timekeeping signals and said secondary signals, at least one of said hands selectively moving with an erratic motion when said secondary signals are selected.

2. An electronic timepiece as claimed in claim 1, wherein said switch means is adapted to select said modes alternately, whereby alternate periods of normal timekeeping and erratic motion are provided for said at least one hand.

3. An electronic timepiece as claimed in claim 1 or 2, wherein said means for inputting a secondary signal includes at least two dividers receiving signals from said timekeeping divider circuit and outputting a plurality of different frequency signals;

means for selectively mixing said plurality of signals with an output from said timekeeping divider circuit to provide said erratic secondary signal.

4. An electronic timepiece as claimed in claim 3, wherein one of said plurality of signals is inputted to said selecting means, said signal input to said switch means causing said modes to be alternately selected.

5. An electronic timepiece as claimed in claim 4, wherein said switch means is adapted to receive an externally initiated signal, said externally initiated signal placing said timepiece in said normal mode of operation.

6. An electronic timepiece as claimed in claim 5, and further comprising a switch, closing said switch generating said externally initiated signal.

7. An electronic timepiece as claimed in claim 2, and further comprising a switch, closing said switch causing said switch means to select said normal mode.

8. An electronic timepiece as claimed in claim 1 or 2, wherein said erratic motion further includes a period of normal motion.

9. An electronic timepiece as claimed in claim 1 or 2, wherein said accelerated hand motion is one of forward and reverse motion.

10. An electronic timepiece as claimed in claim 1 or 2, wherein said erratic motion includes two periods of accelerated hand motion, said periods being a period of forward and a period of reverse hand motion.

11. An electronic timepiece as claimed in claim 3, wherein said means for selectively mixing said plurality of signals with an output from said timekeeping divider circuit includes an AND gate.

12. An electronic timepiece as claimed in claim 9, wherein said reverse motion is produced by a driving signal comprised of two consecutive pulses of the same polarity followed by two consecutive pulses of the opposite polarity.

13. An electronic timepiece as claimed in claim 12, wherein consecutive signals of opposite polarity have different pulse widths.

14. An electronic timepiece as claimed in claim 13, wherein a shorter signal precedes a longer signal of opposite polarity.

15. An electronic timepiece as claimed in claim 14, wherein the opposite polarity signals are 3 and 5 milliseconds respectively.

* * * * *